US007686103B2

(12) United States Patent
Pile

(10) Patent No.: US 7,686,103 B2
(45) Date of Patent: Mar. 30, 2010

(54) DRILL BIT WITH RADIALLY EXPANDABLE CUTTER, AND METHOD OF USING SAME

(75) Inventor: James D. Pile, Farmington, NM (US)

(73) Assignee: San Juan Coal Company, Farmington, NM (US)

( * ) Notice: Subject to any disclaimer, the term of this patent is extended or adjusted under 35 U.S.C. 154(b) by 0 days.

(21) Appl. No.: 11/758,913

(22) Filed: Jun. 6, 2007

(65) Prior Publication Data

US 2008/0302577 A1 Dec. 11, 2008

(51) Int. Cl.
*E21B 7/28* (2006.01)
*E21B 10/32* (2006.01)
*E21B 10/34* (2006.01)

(52) U.S. Cl. ..... 175/292; 175/384; 175/291; 175/274; 82/1.2

(58) Field of Classification Search ..... 175/292, 175/291, 57, 384, 427, 274, 263, 266; 408/1 R, 408/224, 225; 82/1.2, 1.4, 1.5
See application file for complete search history.

(56) References Cited

U.S. PATENT DOCUMENTS

| | | | | | |
|---|---|---|---|---|---|
| 128,747 | A | * | 7/1872 | Perin et al. | 175/267 |
| 1,559,761 | A | * | 11/1925 | Nebergall | 175/267 |
| 1,590,422 | A | * | 6/1926 | Collier | 175/292 |
| 1,779,575 | A | * | 10/1930 | Wilson | 175/292 |
| 1,809,820 | A | * | 6/1931 | Campbell | 175/292 |
| 1,839,588 | A | * | 1/1932 | Raymond | 175/270 |
| RE19,281 | E | * | 8/1934 | Schroeder | 175/273 |
| 3,960,222 | A | | 6/1976 | Leibee et al. | |
| 4,046,205 | A | * | 9/1977 | Asayama | 175/292 |
| 4,603,751 | A | | 8/1986 | Erickson | |
| 4,605,079 | A | | 8/1986 | Leibee et al. | |
| 4,744,699 | A | | 5/1988 | Price et al. | |
| 5,219,246 | A | * | 6/1993 | Coutts et al. | 405/237 |
| 5,400,861 | A | | 3/1995 | Sheirer | |
| 6,026,918 | A | | 2/2000 | Briese | |
| 6,176,332 | B1 | | 1/2001 | Massa et al. | |
| 6,260,638 | B1 | | 7/2001 | Massa et al. | |
| 6,315,064 | B1 | | 11/2001 | Massa et al. | |

FOREIGN PATENT DOCUMENTS

| | | |
|---|---|---|
| DE | 477 764 | 6/1929 |
| DE | 24 31 113 A1 | 1/1976 |

OTHER PUBLICATIONS

Giraldo, L. et al., "Application of Helical Drag Bit Technology for Mining Operations", *SME Annual Meeting*, pp. 1-8, 2005.
Giraldo, L. et al., "Improved Pull Out Strength of Fully Grouted Roof Bolts Through Hole Geometry Modification", *24th International Conference on Ground Control in Mining*, pp. 279-284, 2005.
PCT/US2008/065473 Search report dated Mar. 6, 2009 Issued from the PCT International Bureau.

* cited by examiner

*Primary Examiner*—Jennifer H Gay
*Assistant Examiner*—Cathleen R Hutchins
(74) *Attorney, Agent, or Firm*—Brinks Hofer Gilson & Lione; G. Peter Nichols

(57) ABSTRACT

A drill bit having a body with a stationary cutter and a rotatable cutter such that in a first position the rotatable cutter does not radially extend beyond a periphery of the stationary cutter and in a second position the rotatable cutter radially extends beyond the periphery of the stationary cutter.

3 Claims, 6 Drawing Sheets

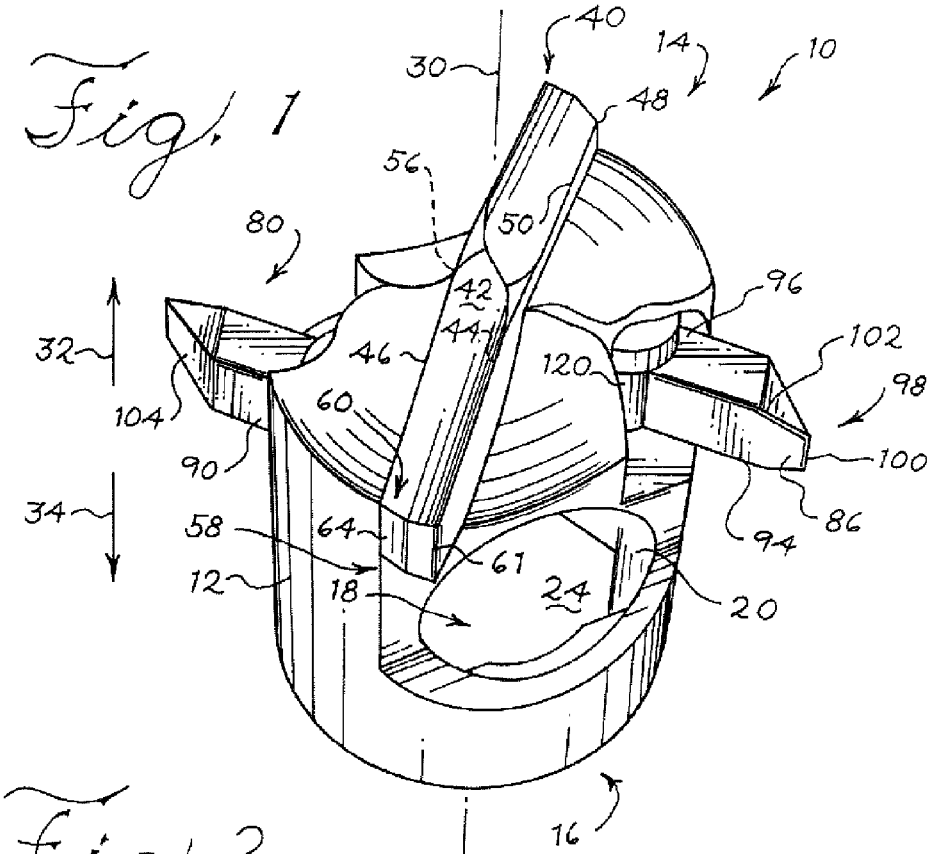
Fig. 1
40
14
10
30
48
56
50
80
42
44
96
32
46
120
102
104
60
98
90
100
34
58
64
94
86
61
12
18
24
20
16
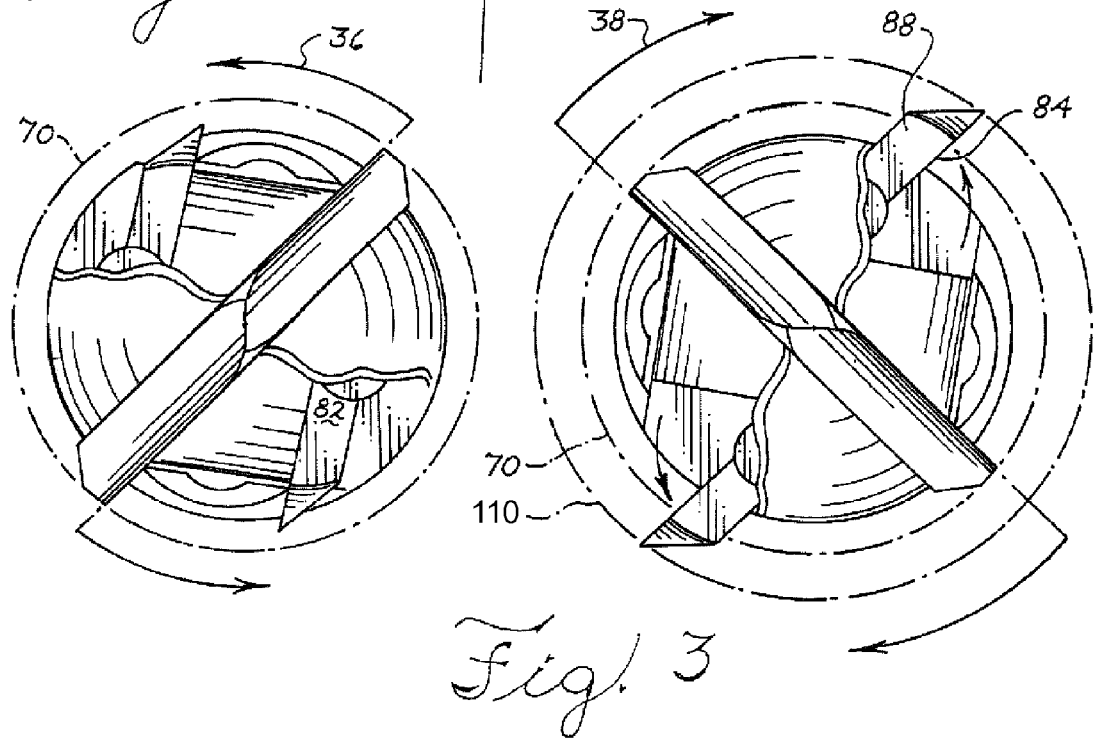
Fig. 2
36
38
88
70
84
82
70
110
Fig. 3

DRILL BIT WITH RADIALLY EXPANDABLE CUTTER, AND METHOD OF USING SAME

FIELD OF THE INVENTION

The present invention relates to a cutting bit for creating a rifled pattern on the wall in a single pass. The cutting bit is useful for cutting through various earth strata and can be used for drilling bore holes in an underground mine.

BACKGROUND OF THE INVENTION

In mining operations, such as coal mining, the roof may be supported by roof bolts that are embedded within spaced apart holes that have been drilled in the mine roof. A common roof drill bit design uses a cutting insert that has been brazed or otherwise attached into a slot at the axially forward end of the roof drill bit body.

The roof drill bit is then pressed against the roof and drilling apparatus operated to drill a bore hole in the roof. The bore hole may extend between two feet to greater than twenty feet into the roof. The bore hole is then filled with resin or other grout material and the roof bolt is affixed with the bore hole. A roof support, such as a plate or roof panel, may be attached to the roof bolt.

A fully grouted bolt anchors itself by frictional interlock between the resin and the rock. Thus, drill bit manufacturers may use wide tolerances or offset bit cutters to induce wobble during drilling which, when combined with loose bit mounting to the drill rod produces ridges on the hole walls. The ridges produce a wall roughness that may increase anchoring capability.

Another method of producing wall roughness is to use a drill bit with cutting members arranged in a helical pattern on the periphery of a central hub to form a helical grove or thread. This drill bit, however, must follow a standard cutting bit, which requires an additional process step. This additional process step is generally undesirable since it increases the roof bolt installation time. One solution that has been proposed is to use a helical roof bolt that will cut a helical groove in the borehole as part of the roof bolt installation process (which occurs after the bore hole is created). A problem with this approach is that the cuttings produced during installation of the roof bolt may contaminate the resin and reduce the cross-sectional area available for the resin to bond.

The present invention provides a cutting drill bit that can create a helical or rifled pattern on the bore hole wall in a single pass. Advantageously, practice of the invention may include the use of resin or it may be dispensed with. In addition, the principles of the present invention are advantageously used with both vacuum drill bits and wet drill bits.

SUMMARY OF THE INVENTION

The present invention provides a drill bit that has a cutting tip and at least one movable wing. The cutting tip defines an outer peripheral surface. When the drill bit is rotated in a first direction, the wing is in a first position and when the drill bit is rotated in a second position, the wing is in a second position. In addition, when the wing is in the first position, its distal portion does not extend beyond the outer peripheral surface. When the wing is in the second position, its distal portion extends beyond the outer peripheral surface. Accordingly, when the drill bit is rotated in a first direction and moved in a first axial direction, e.g., pressed against a stratum, a bore hole having a nominal diameter is created in the strata. When the drill bit is rotated in a second direction, a groove is formed in the bore hole. Generally, the drill bit is rotated in a second direction and is moved in a second axial direction opposite the first axial direction to create a groove having a selected pitch.

BRIEF DESCRIPTION OF THE DRAWINGS

FIG. 1 is a top perspective view of the drill bit of the present invention with the rotatable cutter in the second or extended position.

FIG. 2 is a top view of the drill bit of FIG. 1 with the rotatable cutter in the first position.

FIG. 3 is a top view of the drill bit of FIG. 1.

DETAILED DESCRIPTION OF THE EMBODIMENTS

Figure 4:
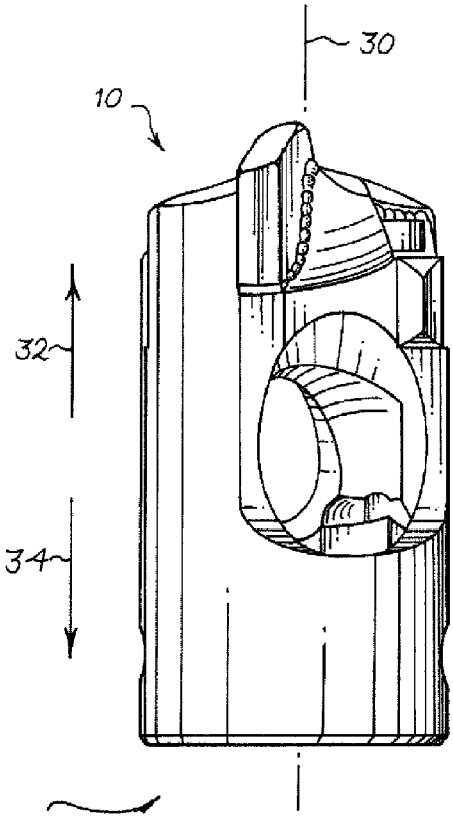
FIG. 4 is a front view of the drill bit of FIG. 1.

The drill bit 10 according to the present invention includes an elongate bit body 12 having a forward end 14 and a rearward end 16 that defines a longitudinal axis 30. The bit 10 includes a first stationary cutter 40 with a first cutting edge 60 that defines a first periphery 70. The bit 10 also includes a first rotatable cutter 80 with a cutting edge 100 that, in a first position, does not radially extend beyond the first periphery 70 and in a second position radially extends beyond the periphery 70 to define a rotatable cutter periphery 110. As a result, the stationary cutter 40 cuts a nominal hole diameter D in a strata and the rotatable cutter 80 cuts a groove within the hole that has a diameter that is greater than D.

Turning now to the drawings, one embodiment of a rotatable cutting bit 10 (and specifically a roof drill bit) is shown. The cutting or drill bit 10 includes an elongate bit body 12, which may be made of steel. The drill bit 10 has an axially forward end 14 and an opposite axially rearward end 16. The bit body 12 has a central longitudinal axis 30 and, when in operation, has a direction of rotation 36 indicated by the arrow and referred to as the hole boring direction of rotation 36.

The axially forward end 14 presents a generally frustoconical shape. The rearward end 16 is open to define an interior bore 18. The bore 18 is shaped to receive a corresponding stem of a drill stem (not shown). As shown in FIG. 1, the open end has a hexagonal configuration 20 to define a socket within which to receive a correspondingly hexagonal end of a drill stem (not shown). A female receptacle 22 may be provided through a peripheral portion of the body 12, adjacent the rearward end 16 to receive a detent or male keeper provided on the drill stem (not shown).

The body 12 may contain one or more debris evacuation passages 24 disposed in the elongate body. The passage 24 provides communication between the interior bore 18 or cavity provided from the rearward end 16 and a portion of the bit body 12 axially forward of the rearward end 16.

Although the drill bit 10 can be used for dry drilling (i.e., drilling the earth strata without using any coolant or the like), it is contemplated that the present bit may be used in a wet drilling operation. In a wet drilling operation, the passage 24 may function to provide a pathway for a flow of fluid (e.g., water) to the forward end 14 of the bit body 12, i.e., fluid would flow through the passages. It is also contemplated that for a wet drilling operation, the outside surface of the bit body 12 may contain flats, or some other relief in the surface, to provide a passage for the fluid and debris to exit from near the cutting inserts.

The elongate bit body 12 also contains at least one seat 26 to receive a respective cutting insert that defines the stationary cutter 40. Although the embodiment shown in FIG. 1 shows a single seat extending across a diameter of the bit body 12, there is no intention to limit the invention to the use of a single cutting insert (and seat). In that regard, it is contemplated that the invention would function with two or more cutting inserts (and seats). The dimension of the cutting bit body and the cutting inserts, as well as the particular cutting application, are factors that may influence the number of cutting inserts (and seats) presented by the rotatable cutting bit. Where more than one cutting insert is provided, it should be appreciated that they may have an identical shape or may have a shape different from each other.

The cutting insert or stationary cutter 40 has a top surface 42 with a leading edge 44 and a trailing edge 46. The leading edge 44 may be angled from a horizontal plane 52 axially rearward to the trailing edge 46. The cutting insert 40 further includes an interior side surface 56 and an exterior side surface 58. Where only a single cutting insert 40 is provided, it will be understood that the interior side surface 56 of each cutting insert (where two are provided) will be joined so that there will be no apparent interior side surface, as seen in FIG. 1.

The exterior side surface 58 includes a cutting edge 60. The cutting edge 60 may have any suitable configuration suitable for cutting a desired bore hole. For example, and as shown in the figures, the cutting edge 60 may include a tip 61 and a side bevelled edge 64. A bevelled edge may be provided on the top as well.

In operation, the drill bit 10 rotates in a hole boring direction 36 so that the top leading edge 44 first impinges the earth strata while the side cutting edge 60 cuts the outside of the hole. The exterior side cutting edge 60 is radially outward of the drill bit 10 outer circumference or periphery and defines a radial periphery 70 that defines the nominal diameter of the bore hole D.

The cutting insert 40 may be affixed by brazing or welding to the seat 26 of the cutting bit body. As will become apparent from the following description and is apparent from the drawings, the surface area of the bottom surface 54 of the cutting insert is greater than the surface area of the top surface 42. The bottom surface 54 provides the major area for securing the cutting insert 40 to the cutting bit body 12. By using the larger bottom surface 54 to form the braze joint, the cutting insert 40 can be secured to the cutting bit body 12 using a relatively shallow seat that does not require a large shoulder. The use of such a shallow seat may reduce the expense associated with the manufacture of the cutting bit body 12.

The cutting insert 40 may be made from a cemented carbide such as, for example, cobalt cemented tungsten carbide. For instance, the cobalt may range between about 2 weight percent and about 20 weight percent with the balance being tungsten carbide. One of skill in the art will understand, however, that other materials suitable for use as a cutting insert may also be appropriate to use for the cutting insert. These materials include ceramics (e.g., silicon nitride-based ceramics, and alumina-based ceramics), binderless tungsten carbide, polycrystalline diamond composites with metallic binder, polycrystalline diamond composites with ceramic binder, tungsten carbide-cobalt alloys having a hardness greater than or equal to about 90.5 Rockwell A, and hard coated cemented carbides.

As noted above, the drill bit 10 includes at least one rotatable cutter 80. As shown in FIG. 1, the drill bit 10 includes two rotatable cutters. It is contemplated that the invention is not limited by the number of rotatable cutters but, in general, the drill bit 10 will have two rotatable cutters. For ease of discussion, only a single rotatable cutter will be discussed since the operation of each rotatable cutter is intended to be the same, although each cutter may have different structural components or may have a different configuration.

Figure 5:
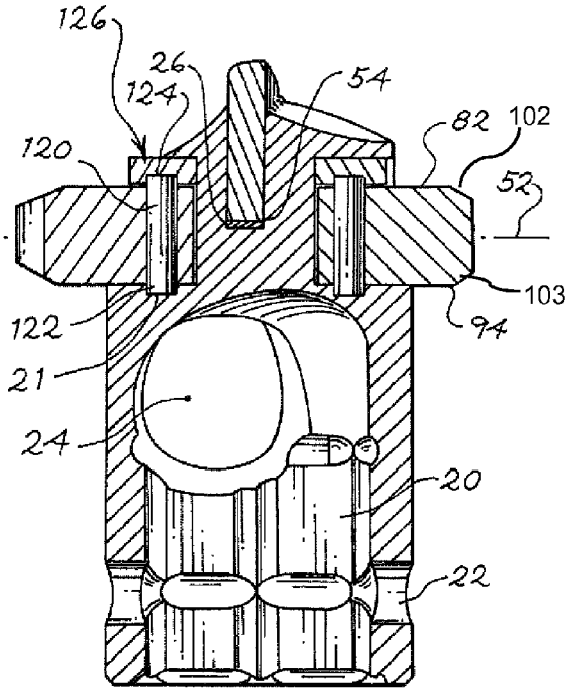
FIG. 5 is a cross sectional view of the drill bit of FIG. 1 along the longitudinal axis.

Turning now to FIGS. 1, 4, and 5, the rotatable cutter 80 of FIG. 1 is shown. The rotatable cutter 80 has a top surface 82, a bottom surface 94, an interior side 96, and an exterior side 98. In the embodiment shown in FIG. 1, the top surface 82 is generally horizontal or has a plane that is generally perpendicular to the longitudinal axis. The top surface 82 has a leading edge 84 at an intersection of a leading face 86 and the top surface 82 and a trailing edge 88 at an intersection of a trailing face 90 and the top surface 82. While the leading edge 84 may be in the same plane as the trailing edge 88, it may be desirable in some embodiments to configure the leading edge 84 so that it is angled from a horizontal plane 52 axially forward or rearward to the trailing edge 88. The rotatable cutter further includes an interior side 96 and exterior side 98. The exterior side 98 includes a cutting tip or edge 100. The cutting edge 100 may have any suitable configuration suitable for cutting a desired groove. For example, and as shown in the figures, the cutting edge 100 may include a top bevelled edge 102, a bottom bevelled edge 103, and a side bevelled edge 104. Alternatively, only one of the top or bottom or side bevelled edges may be provided. The interior side 96 is rotatably connected to a portion of the drill bit body 12, as will be explained in more detail below.

In operation, when the drill bit 10 is rotated in the hole boring direction 36, the rotatable cutter 80 is in a first position, best seen in FIG. 2. In this first position, the cutting tip 100 of the rotatable cutter 80 does not extend beyond the periphery defined by stationary cutter 70. In one embodiment, as shown for example in FIG. 2, the leading face 86 is in contact with a portion of the drill bit 10. As the drill bit 10 is rotated in the hole boring direction 36, the bit is moved in an axial forward direction 32. When the drill bit 10 reaches the forward most travel extent, i.e., when the desired hole length has been reached, the drill bit 10 is rotated in an opposite direction 38 and the bit is moved in an axial rearward direction 34 opposite the axial forward direction 32. When the drill bit 10 is rotated in this direction 38, the rotatable cutter 80 assumes a second position. In this second position, the cutting tip 100 of the rotatable cutter 80 extends radially outward to define a rotatable cutter periphery 110 which is located radially outward of the periphery 70 defined by the stationary cutter 40. As a result, the cutting tip 100 of the rotatable cutter 80 creates a groove within the bore hole and, as the drill bit 10 is moved axially, a radial or helical groove is created. Advantageously, the bore hole and groove can be created in a single pass of the drill bit, which creates a time savings, particularly compared to a two-pass system.

The extent that the rotatable cutter cutting tip 100 radially extends beyond the periphery defined by the stationary cutter 70 defines a thread or groove depth d. The distance between the top surface and the bottom surface defines a thread or groove width w. The distance between axially adjacent grooves, which is created as the drill bit is moved in axial rearward direction, defines the pitch P. One of skill in the art will understand that several operating variables can be modified, which will affect each of the bore hole diameter D, the pitch P, the groove depth d, and the groove width w.

As seen in FIG. 5, in one particular embodiment of the rotatable cutter 80, the interior side 96 is rotatably secured to the body 20 by a pin 120 that is spaced from the longitudinal axis 30 but is parallel to the longitudinal axis. The pin 120 may be secured to the body 12 in a manner such that the pin 120 is held in place yet allows the rotatable cutter 80 to rotate. For example, the pin 120 may be secured to the body 12 such by brazing, welding, or other expedient means. As shown in FIG. 5, the pin 120 has a first end 122 held within a seat 21 in the body and a second end 124 held within a head 126 that is secured to the body 20. In one embodiment, the bottom surface 94 of the rotatable cutter 80 is generally aligned in a plane 92 that is horizontal (or perpendicular) to the longitudinal axis 30.

Figure 5A:
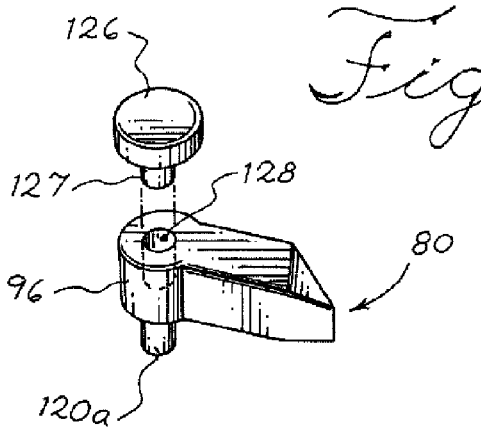
FIG. 5*a* is a detail view of another embodiment of a rotatable cutter that is useful in the drill bit of the present invention.

Alternatively, as shown in FIG. 5*a*, the interior side 96 has a cylindrical shape with a pin 120*a* extending from a bottom side to engage a seat 21 within the body. A head 126 has a pin 127 that engages an aperture 128 provided on the top of the interior side 96 of the cutter 80.

In other embodiments of the present invention, it is contemplated that the bottom surface 94 of the rotatable cutter 80 will be at an angle with respect to a horizontal plane (92 i.e., a plane that is perpendicular to the longitudinal axis 30 and is generally parallel to the rearward end). In this regard, it is contemplated that the pin 120 be aligned in the body in a manner that is not parallel to the longitudinal axis 30 but is angled from the longitudinal axis 30. In this regard, the rotatable cutter will be shaped as shown in FIGS. 1-5.

Figure 7:
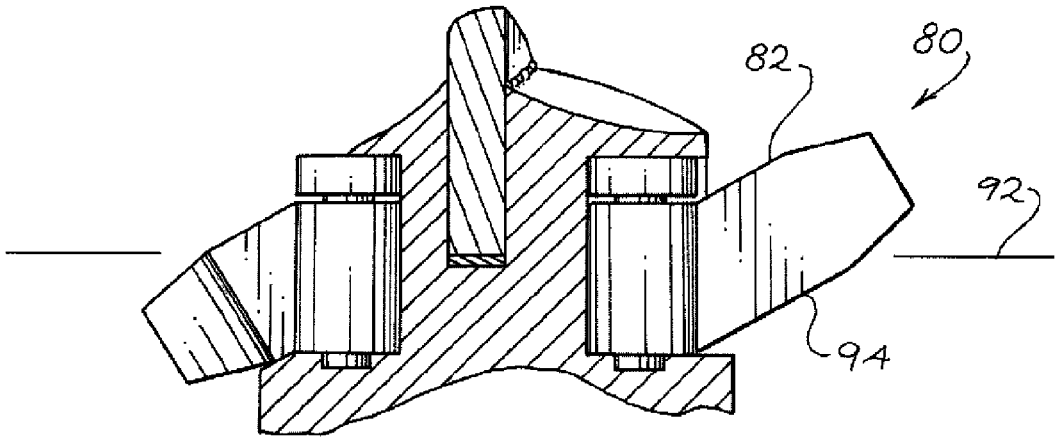
FIG. 7 is a detailed view of another embodiment of a rotatable cutter.

Alternatively, as shown in FIG. 7, it is contemplated that the shape of the rotatable cutter 80 is shaped so that the top surface 82 is at an angle with respect to a horizontal plane 92 (i.e., a plane that is perpendicular to the longitudinal axis 30 and is generally parallel to the rearward end). In other words, the top exterior side is axially forward of the top interior side. Each of these embodiments will likely provide a differing pitch profile as compared to the rotatable cutter of FIG. 1.

Figure 8A:
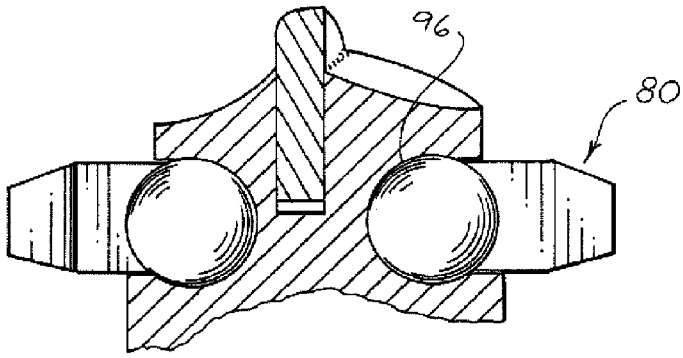
FIG. 8*a* is a detail view of another embodiment of a rotatable cutter.
Figure 8:
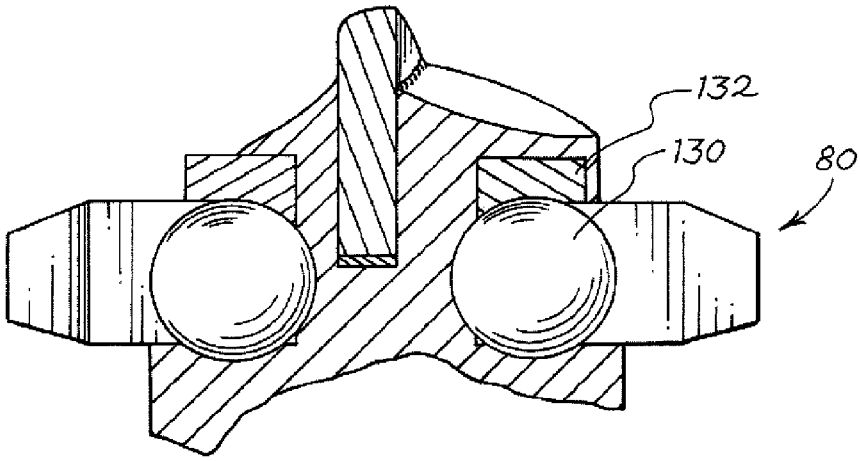
FIG. 8 is a detailed view of another embodiment of a rotatable cutter.

While a pin 120 is shown in FIG. 5, it is contemplated that any suitable rotation connection may be used. Accordingly, as shown in FIG. 8, a ball 130 and socket 132 arrangement is shown. In this embodiment, the interior side 96 of the rotatable cutter 80 has a ball structure 130 while the body 12 has a socket structure 132 that is fixed in the drill bit yet allows the rotatable cutter to rotate with respect to the drill bit. It is contemplated that the ball and socket arrangement could be reversed. Alternatively, as illustrated in FIG. 8*a*, the rotatable cutter can be shaped as a monolithic structure with the interior side 96 being shaped as a ball similar to an ice cream cone shape.

In each of the embodiments of the rotatable cutter 80, it is understood that the rotatable cutter 80 assumes the first position (non-extended or non-deployed) when the bit 10 rotates in the boring direction 36 and assumes the second position (extended or deployed) when the bit 10 rotates in the opposite direction 38. Frictional contact with the earth strata and/or centrifugal force experienced by the rotatable cutter 80 forces it to assume the first or second position, during which opposite sides of the rotatable cutter 80 contact a portion of the body 12, which limits further rotational travel of the rotatable cutter 80.

Figure 6:
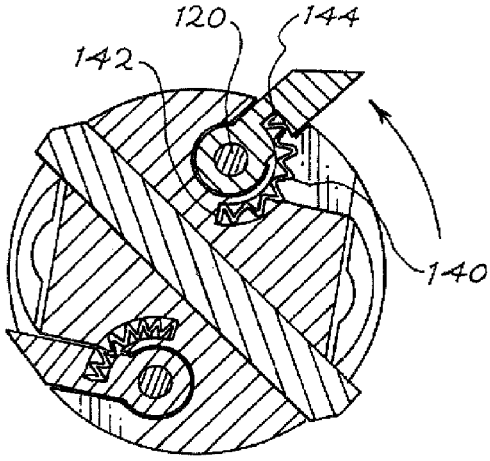
FIG. 6 is a top cross sectional view of a portion of a drill bit according to one embodiment of the present invention having a biasing member with one rotatable cutter shown in an extended position and another rotatable cutter shown in a retracted position.
Figure 6A:
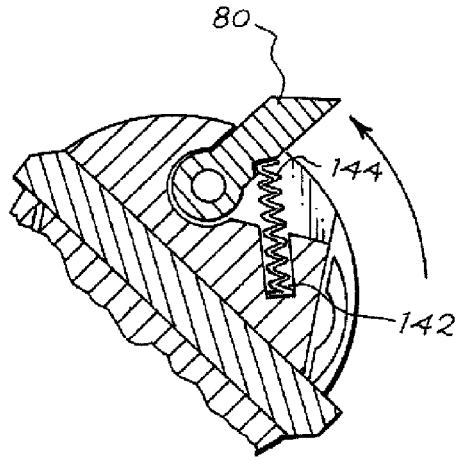
FIG. 6*a* is a detail view of another arrangement of a biasing member for a rotatable cutter.

While, in general, the friction and/or centrifugal force should be sufficient to ensure that the rotatable cutter 80 is in the appropriate first or second position depending on the direction of rotation of the drill bit 10, it is contemplated to provide a biasing member 140 to assist in maintaining the rotatable cutter 80 in the second position. In this regard, FIG. 6 shows a top detail view of one embodiment of the drill bit 10 where a biasing member 140 is provided. In this embodiment, the biasing member 140 may be in the form of a coil spring with one end 142 secured to the body 12 and the other opposite end 144 secured to the rotatable cutter 80. The biasing member 140 in this embodiment is curved around the interior side 96 of the rotatable cutter. Alternatively, as shown in FIG. 6*a*, the biasing member 140 may be arranged so that biasing member 140 maintains a substantially linear profile. While a coil spring is shown, it is contemplated that another biasing member 140 could be used.

Figure 9:
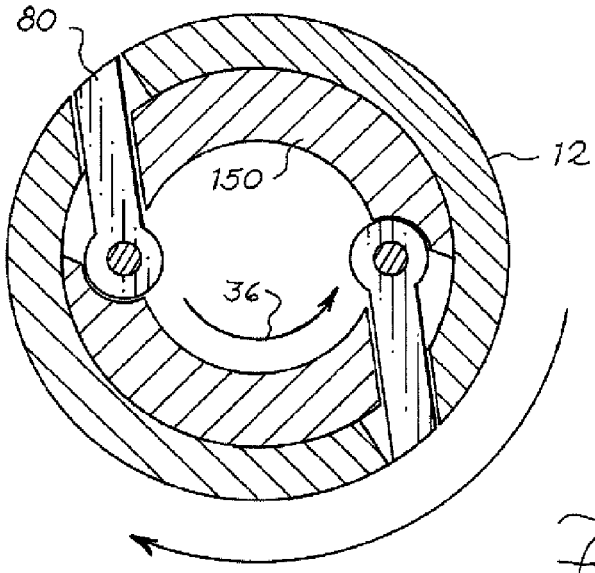
FIG. 9 is a partial top cross sectional view of an actuating mechanism for the rotatable cutters with the stationary cutters not shown to better illustrate the actuating mechanism and with the rotatable cutter in a first position.
Figure 10:
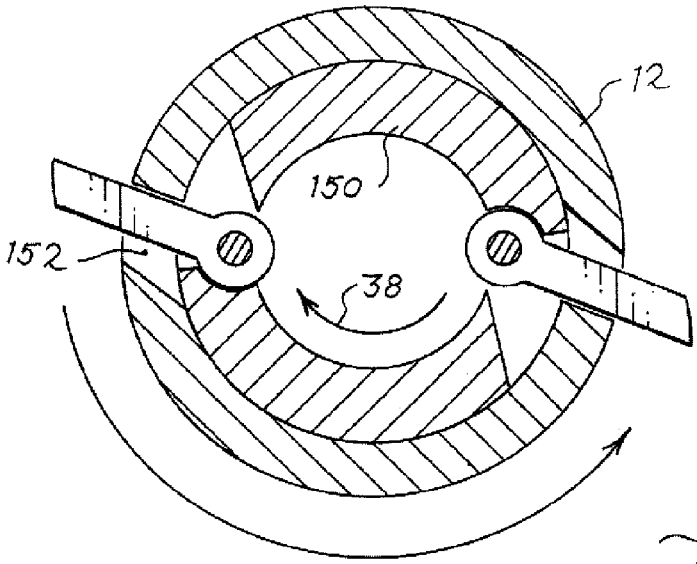
FIG. 10 is a partial top cross sectional view of an actuating mechanism for the rotatable cutters with the stationary cutters not shown to better illustrate the actuating mechanism and with the rotatable cutter in a second position.

Turning to FIGS. 9 and 10, another embodiment of a rotatable cutter extending mechanism is shown without the stationary cutters. In this embodiment, an actuating member 150 is provided to actuate or move the rotatable cutter 80 to the second position. The actuating member can be disposed in an axial manner from the rearward end 16 toward the forward end 14 and operated from a location remote from the rotatable cutter 80. As shown in FIG. 9, the actuating member 150 carries the rotatable cutter in a manner that allows the actuating member to rotate with respect to the drill bit body 12. In this position, the stationary cutters cut through the strata as explained above and the rotatable cutters do not extend radially outward beyond the radial periphery defined by the stationary cutters.

When the drill bit 10 is rotated in the opposite direction 38, the actuating member can rotate with respect to the drill bit body 12 such that the rotatable cutter 80 extends radially outward beyond an opening 152 provided in the drill bit body to cut the groove as explained above.

Accordingly, the present invention provides a drill bit 10 that is suitable for creating a bore hole for roof bolts in mine applications. In this regard, the bore hole created by the drill bit 10 of the present invention provides a desirable surface area to enhance the bonding interlock of roof bolts grouted with resin or other materials. The present invention therefore encompasses a method of providing a bore hole in a stratum. The method includes providing a drill bit 10 according to any of the embodiments described above and then rotating drill bit 10 in a first direction 36 and moving the drill bit 10 in a first axial direction 32; and, subsequently, rotating the cutting bit a second direction 38 opposite the first direction and moving the cutting bit in a second axial direction 34 opposite the first direction. As a result, a bore hole having a nominal diameter D is created with a spaced helical groove created within the periphery of the nominal hole diameter D.

The following examples are meant to describe the invention but are not meant to limit the scope of the invention.

EXAMPLE 1

Four, five and six foot long holes were drilled into strata at the San Juan Mine in Waterflow, N. Mex. with the same drill bit. Roof bolts were installed with resin in a conventional manner and then Short Encapsulation Pull Tests (SEPT) were performed. Anchorage capacities in the range of 12 to 24 tons per foot of resin encapsulation have been accepted by the industry as an acceptable or "good" anchorage capacity. Previously, it has been found that carbonaceous shales and mudstones exhibited anchorage capacities in the range of 4 to 7 tons per foot. In contrast, typical coal horizons have exhibited anchorage capacities in the range of 10 to 15 tons per foot of resin encapsulation.

A conventional hole was created by rotating the drill bit in a first direction (the bore hole direction) and axially inserting and removing the drill bit while rotating the drill bit in the first direction. A rifled hole was created by rotating the drill bit in a first direction and axially inserting the drill bit. Thereafter, the drill bit was rotated in the second reverse opposite direction and axially removed from the created hole. The following table shows the results:

| | | | |
|---|---|---|---|
| Bolt Length (feet) | 4 | 5 | 6 |
| Average Pull Load for Conventional Holes (tons) | 6.8 | 6.0 | 5.0 |
| Average Pull Load for Rifled Holes (tons) | 20.4 | 17.8 | 14.3 |
| Improvement (%) | 302 | 297 | 286 |

Advantageously, the bore hole created with the drill bit of the present invention will allow the use of fewer, shorter, thinner, and thereby lighter weight bolts to achieve the same, or enhanced, level of roof support when compared with conventional roof bolts in the same strata. The drill bit of the present invention may also allow the use of shorter anchors with point anchored roof support products.

In addition, use of the drill bit according to the present invention will keep the installation time virtually unchanged as only a single pass is required. Also, because a vacuum is maintained during the drill bit removal, the cuttings produced by the drill bit are removed from the hole. This will eliminate resin contamination and consequent reduction in the cross sectional area of the root of the resin keyed into the grooves. This likely contributes to higher anchorage capacities. The use of vacuum also limits the operator's exposure to dust.

EXAMPLE 2

Figure 11:
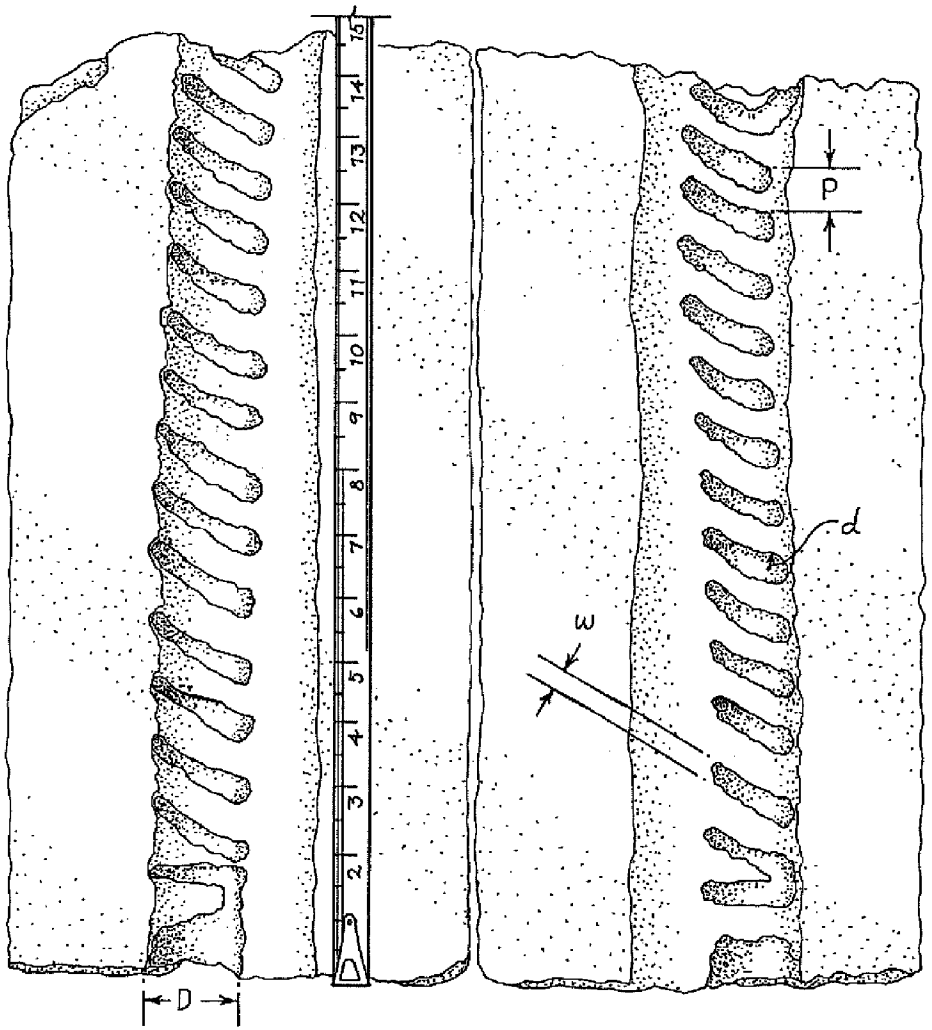
FIG. 11 is a picture of a test bore hole that shows the grooves created by the drill bit shown in FIG. 1.

A drill bit according to the present invention was used to create a bore hole in a typical block made of foamed cementitious material and subsequently used to create the helical grooves as described above. The foamed cementitious block was cut along a longitudinal axis to expose the rifling pattern created by the use of the drill bit of the present invention in the manner described above. The exposed pattern is seen in FIG. 11. It will be seen that the drill bit created a bore hole having a diameter "D" of about 1 inch, a helical pitch "P" of about 1 inch, a thread or groove depth "d" of about 0.5 inch, and a thread or groove width "w" of about 0.25 inch. It should be understood that each of the parameters can be adjusted in a suitable manner to create the desired profile.

It is also contemplated that the drill bit of the present invention can be used in the installation of roof bolts without having to use resin. In this regard, the rotatable cutters 80 are configured to match the pitch of the threads on the roof bolt so that the roof bolt can be threaded at the terminal end of the bore hole. Accordingly, in this method, a bore hole is created using the drill bit 10 according to any of the embodiments of the present invention where the rotatable cutters 80 are configured such that the pitch created in the bore hole matches the pitch of the threads of the roof bolt that will be used. Advantageously, the roof bolt used in this application need only be threaded at the terminal end (i.e., at the portion of the bolt near the terminal end of the bore hole). As a result, the nominal size of the bore hole need not be larger than the roof bolt, which is typical in order to accommodate resin. As a result, a drill bit having any suitable size such as 0.750 inches, 0.875 inches, 1.000 inches, 1.125 inches, 1.250 inches, 1.375 inches or any suitable size may be used.

Although the drill bit 10 of the present invention has been described with respect to a roof drill bit, it should be appreciated that the invention contemplates other uses. In that regard, other embodiments of the present invention will be apparent to those skilled in the art from a consideration of the specification. It is therefore intended that the specification be considered as illustrative only and that this invention is not limited to the particular embodiment described above.

The invention claimed is:

1. A method of creating a helical groove in a bore hole formed in a strata comprising:

a. providing a drill bit having:
   i. an elongate bit body having a forward end and a rearward end,
   ii. a first stationary cutter located at the forward end and having a cutting edge that defines a periphery;
   iii. a first rotatable cutter having a cutting edge that in a first position does not extend beyond the periphery and in a second position extends beyond the periphery;

b. rotating the bit in a first rotation direction such that the first rotatable cutter is in the first position and moving the bit in a first axial direction into the strata to create the bore hole having a nominal diameter and an axial length; and, c. subsequently rotating the bit in a second rotation direction opposite the first rotation direction such that the first rotatable cutter is in the second position and moving the bit in a second axial direction opposite the first axial direction to create the helical groove within at least a portion of the axial length of the bore hole wherein the helical groove has a groove depth that extends radially beyond the nominal diameter.

2. The method of claim 1 wherein the bit is moved in the first axial direction to a preselected terminal end and when the bit reaches the terminal end, the bit is rotated in the second rotation direction.

3. The method of claim 1 wherein the first stationary cutter is configured to create the bore hole with the nominal diameter between about 0.750 inches to about 1.375 inches.

* * * * *